United States Patent [19]

Vander Ley

[11] 4,423,914

[45] Jan. 3, 1984

[54] DRAWER SLIDE LOCKING LEVER

[75] Inventor: Robert J. Vander Ley, Jenison, Mich.

[73] Assignee: Knape & Vogt Manufacturing Co., Grand Rapids, Mich.

[21] Appl. No.: 264,273

[22] Filed: May 18, 1981

[51] Int. Cl.[3] ..... A47B 88/16

[52] U.S. Cl. ..... 312/333; 312/348; 312/349; 308/3.8

[58] Field of Search ..... 312/333, 348, 242, 12; 49/450, 449; 308/3.8

[56] References Cited

U.S. PATENT DOCUMENTS

| | | | |
|---|---|---|---|
| 534,434 | 2/1895 | Frost . | |
| 1,557,765 | 10/1925 | Nicholas | 312/348 |
| 1,580,666 | 4/1926 | Hansen | 49/449 |
| 2,277,702 | 3/1942 | Kennedy . | |
| 2,277,703 | 3/1942 | Kennedy et al. . | |
| 2,561,163 | 7/1951 | Wolters | 308/3.8 |
| 2,561,295 | 7/1951 | Stone | 312/333 |
| 2,655,422 | 10/1953 | Gussack | 312/333 |
| 2,687,924 | 8/1954 | Gomersall | 308/3.8 |
| 2,760,803 | 8/1956 | Solomon | 49/449 |
| 3,092,429 | 6/1963 | Barnes | 312/333 |
| 3,141,714 | 7/1964 | Valitus | 312/348 |
| 3,142,517 | 7/1964 | Ward | 312/348 |
| 3,161,923 | 12/1964 | Crain | 49/449 |
| 3,166,285 | 1/1965 | Downes . | |
| 3,219,404 | 11/1965 | Machingo et al. | 312/333 |
| 3,259,447 | 7/1966 | Deutsch | 312/348 |
| 3,315,431 | 4/1967 | Yake . | |
| 3,371,968 | 3/1968 | Loake | 312/333 |
| 3,492,772 | 2/1970 | Bergman . | |
| 3,782,800 | 1/1974 | Remington et al. | 312/333 |
| 3,799,638 | 3/1974 | Faiks | 312/333 |
| 3,801,166 | 4/1974 | York | 312/348 |
| 3,866,380 | 2/1975 | Benson . | |
| 3,937,531 | 2/1976 | Hagen et al. | 308/3.8 |
| 3,995,927 | 12/1976 | Stein | 312/333 |
| 4,065,196 | 12/1977 | Stein | 312/333 |
| 4,274,689 | 6/1981 | Vander Ley et al. | 312/333 |

FOREIGN PATENT DOCUMENTS

| | | | |
|---|---|---|---|
| 68363 | 2/1951 | Netherlands | 312/348 |
| 193882 | 2/1938 | Switzerland . | |
| 803331 | 10/1958 | United Kingdom . | |

*Primary Examiner*—Victor N. Sakran

*Attorney, Agent, or Firm*—Price, Heneveld, Huizenga & Cooper

[57] ABSTRACT

A drawer locking lever pivotally mounted between its ends to a drawer mounting strip, with a drawer rail locking element at one end of the lever and an integral deformable spring element at the other end for biasing said locking element toward a drawer rail, there being an actuator element at said other end of the lever for pivoting the lever against the bias of said spring element to release the locking element from the drawer rail.

8 Claims, 7 Drawing Figures

DRAWER SLIDE LOCKING LEVER

BACKGROUND OF THE INVENTION

This invention relates to drawer locking levers.

Drawers are often mounted within cabinets using drawer slides. Such slides permit the drawer to be more fully withdrawn from the cabinet so that the entire interior of the drawer is accessible. Further, the slides maintain the drawer in a horizontal orientation regardless of how far the drawer is withdrawn from the cabinet. These slides have long been known as shown in U.S. Pat. No. 2,277,702 issued Mar. 31, 1942 to Kennedy and U.S. Pat. No. 2,277,703 issued Mar. 31, 1942 to Kennedy et al.

Occasionally, a drawer must be removed from the cabinet, for example for repair or maintenance. Therefore, the slides preferably include means for allowing the drawer to be readily removed from the cabinet. Removability has been previously accomplished by releasably mounting one rail of the slide within the second rail. This construction is shown in the previously cited patents as well as U.S. Pat. No. 3,092,429 issued June 4, 1963 to Barnes, U.S. Pat. No. 3,995,927 issued Dec. 7, 1976 to Stein, and U.S. Pat. No. 4,065,196 issued Dec. 27, 1977 to Stein. This construction is not without disadvantages. For example, ball bearings cannot practically be positioned between the interfitting rails to facilitate movement because the bearings fall out of the assembly when the two rails are separated. Reinserting the drawer into the cabinet is difficult because the ball bearings have to be repositioned between the interfitting rails.

In order to construct a drawer slide in which the telescoping rails are permanently interfitted with ball bearings and in which the drawer is readily removable from the cabinet, one may either removably mount the drawer on the slide or the slide on the cabinet. Because the drawer rail is more readily accessible than the cabinet rail, prior artisans have releasably mounted the drawer on the drawer rail as shown in U.S. Pat. No. 3,937,531 issued Feb. 10, 1976 to Hagen et al. In this type of construction, a mounting strip is permanently affixed to the drawer, and the drawer slide is permanently mounted on the interior of the cabinet. The drawer is installed on the slide assembly by securing the drawer mounting strip to a portion of the drawer slide assembly. The mounting strip is installed by placing the mounting strip on a forward portion of the drawer rail and sliding the drawer into the cabinet so that the rear edge of the mounting strip slides under a forwardly extending tab on the drawer slide and a rearwardly extending tab on the mounting strip engages the drawer slide. Finally, some type of lock or latch prevents the mounting strip from sliding forwardly on the drawer rail thereby locking the mounting strip and drawer rail together.

Latching mechanisms previously used to prevent lateral movement of the mounting strip on the drawer rail have typically been gravity latches, for example as shown in U.S. Pat. No. 3,937,531, and spring latches. To insure that the gravity latches function properly, they must be made of a relatively heavy metal to overcome the friction of the pivotal mount. Consequently, these metal latches are expensive and complex to manufacture. Prior spring latches, typically made of metal, are also expensive and complex to manufacture because the latching element and the spring are usually two separate pieces.

SUMMARY OF THE INVENTION

The afore-mentioned problems are solved by the present invention. Essentially, a unitary, polymeric drawer locking lever having an integral spring is provided to prevent the drawer mounting strip from moving laterally with respect to the drawer rail. The integral leaf spring biases a locking element at one end of the lever into engagement with the drawer rail. The spring is deformable with depression force on the lever to release the locking element from engagement with the drawer rail. Consequently, a one-piece, positive-action drawer slide locking lever is provided fabricated from a relatively inexpensive material.

These and other objects, advantages, and features of the invention will be more fully understood and appreciated by reference to the written specification and appended drawings.

DESCRIPTION OF THE PREFERRED EMBODIMENT

Figures 1, 2:
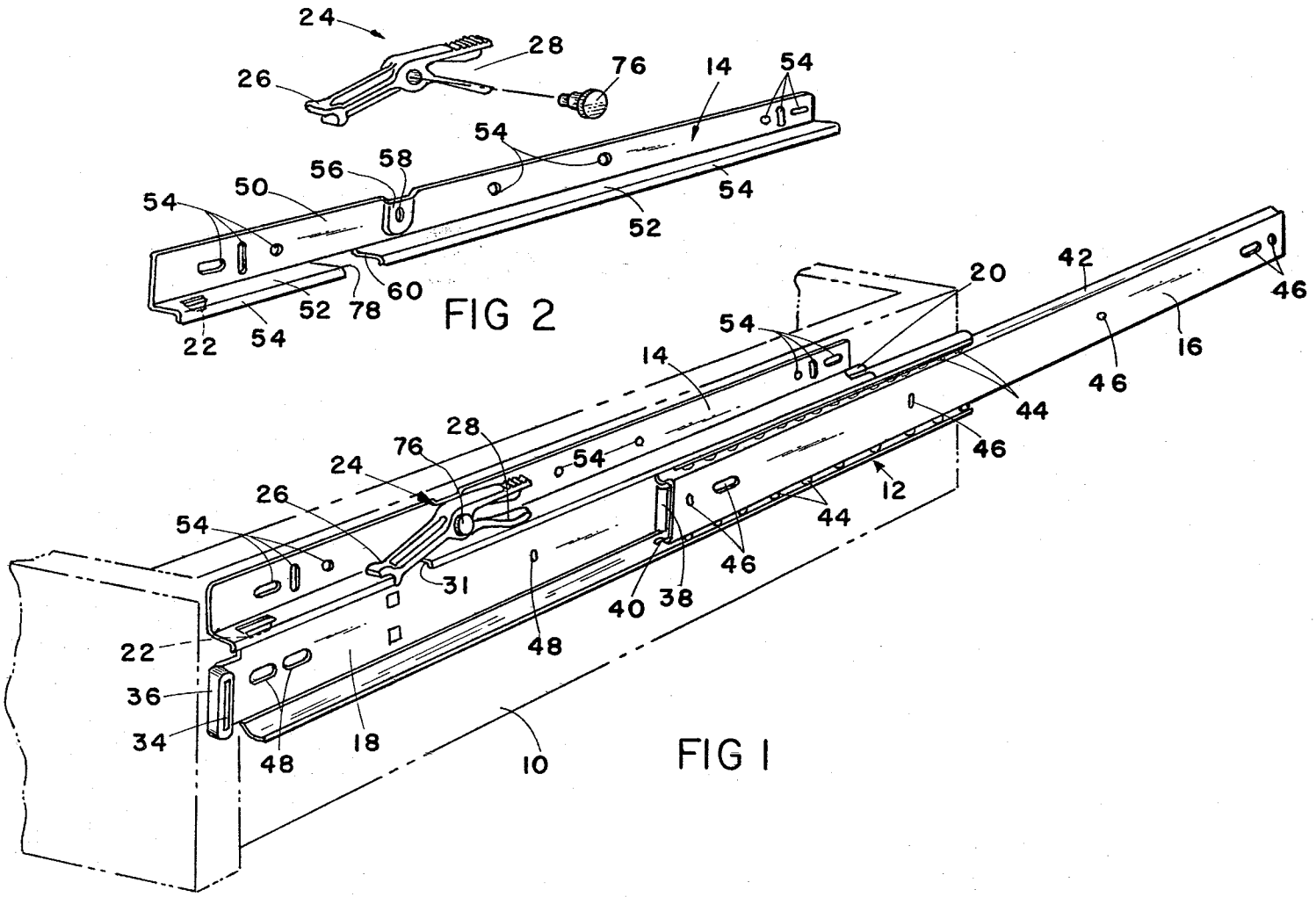
FIG. 1 is a perspective view of a drawer slide assembly including the locking lever of the present invention.
FIG. 2 is an exploded view of the drawer mounting strip and locking lever of the present invention.

Referring initially to FIG. 1, a drawer 10 is shown supported on drawer slide assembly 12 by drawer mounting strip 14. Slide assembly 12 generally comprises a cabinet rail 16 secured to the interior of a cabinet (not shown) and a drawer rail 18 upon which mounting strip 14 rests. Cabinet rail 16 is telescopically mounted within drawer rail 18 so that the two pieces can move telescopically as drawer 10 is drawn from and pushed into the cabinet. Mounting strip 14 is held downwardly on drawer rail 18 by drawer rail tab 20 which engages the rear end of mounting strip 14 and mounting strip tab 22 which engages the forward edge of drawer rail 18. Finally, locking lever 24 is pivotally mounted to mounting strip 14 and extends through slot 60 to prevent mounting strip 14 from moving laterally of drawer rail 18 as drawer 10 is withdrawn from the cabinet. Undesired lateral movement would allow tabs 20 and 22 to disengage and release mounting strip 14 from drawer rail 18.

Figure 4:
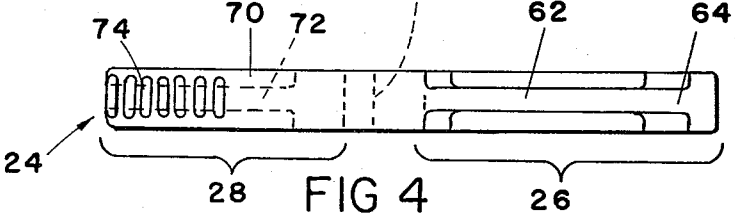
FIG. 4 is a top plan view of the locking lever.
Figure 3:
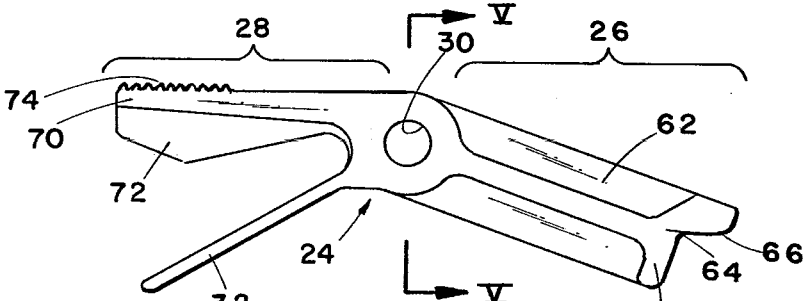
FIG. 3 is a side elevational view of the locking lever.
Figure 5:
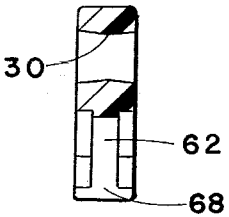
FIG. 5 is a cross sectional view taken along plane V—V in FIG. 3.

Locking lever 24 (FIGS. 3, 4 and 5) is an integral polymeric member having a pair of ends 26 and 28 on either side of an aperture 30. Locking end 26 of lever 24 extends through recess 31 in drawer rail 18 to prevent lateral movement of mounting strip 14 on rail 18. Spring end 28 of lever 24 includes an integral spring 32 which engages mounting strip 14 to bias lever 24 into its locked position as shown in FIG. 1.

As most clearly shown in FIG. 1, drawer rail 18 is a generally C-shaped channel member having an integrally formed stop flange 34 at its forward end. A rubber stop 36 is stretch-fitted onto stop flange 34 to provide a cushioned stopping surface for cabinet rail 16 as will be described. Cabinet rail 16 is also a generally C-shaped channel member having an integrally formed abutment flange 38 at its forward end. Rubber stop 36 engages abutment flange 38 when slide assembly 12 is fully contracted, i.e. when drawer 10 is pushed into the cabinet. Ball retainers 40 and 42, which form the legs of cabinet rail 16, are convex downwardly and upwardly, respectively. Preferably, rails 16 and 18 are fabricated from zinc-plated cold-rolled steel.

When cabinet rail 16 is telescopically fitted within drawer rail 18, a plurality of ball bearings 44 are positioned within ball retainers 40 and 42. The size of ball bearings 44 is selected so that cabinet rail 16 will snugly interfit drawer rail 18 so that slide assembly 12 does not have a loose or sloppy feeling. Further, a snug fit prevents bearings 44 from accidentally falling out of retainers 40 and 42. Although bearings 44 are preferably fabricated from nylon, bearings of other materials may be used.

In the preferred embodiment, a plurality of apertures 46 is provided in cabinet rail 16 so that the rail may be secured to the interior of the cabinet using screws or other suitable fasteners. Although a plurality of apertures 48 is positioned in drawer rail 18, when drawer 10 is mounted using mounting strip 14, apertures 48 are not used.

Mounting strip 14 (FIG. 2) comprises a generally vertical element 50 and lateral element 52 joined along their entire lengths so that mounting strip 14 is generally L-shaped in cross section. Lip 54 extends downwardly from lateral element 52 opposite vertical element 50. Vertical element 50 is provided with a plurality of apertures 54 so that mounting strip 14 may be secured to drawer 10 for example using screws (not shown). Mounting land 56 is formed in vertical element 50 and extends slightly laterally therefrom in the same direction as horizontal element 52. Aperture 58 extends through land 56 providing a pivotal mounting point for locking lever 24 as will be described. Finally, slot 60 extends through horizontal element 52 forward of mounting aperture 58 to cooperate with locking lever 24.

Lever 24 (FIGS. 3, 4 and 5) is a unitary, polymeric mmeber having an aperture 30 extending through a central portion. Extending from either side of aperture 30 are locking end 26 and spring end 28. Locking end 26 comprises locking arm 62 which is generally X-shaped in cross section and a locking element 64 disposed at the terminal end of locking arm 62. Stop surface 66 and projecting tab 68 meet at an obtuse angle to form locking element 64. Spring end 28 of locking lever 24 includes actuator arm or element 70 and integral leaf spring 32. An over-spring stop or rib 72 extends generally perpendicularly from actuator arm 70 toward spring 32 to limit the degree to which spring 32 may be deformed or flexed. Finally, ribs 74 are located in actuator arm 70 to provide an improved friction surface for depressing actuator arm 70 as will be described. Locking lever 24 is a single, polymeric member preferably fabricated from a thermoplastic, acetal resin using injection molding.

Locking lever 24 is pivotally mounted to mounting strip 14 by passing rivet 76 through aperture 30 and into aperture 58. When lever 24 is so installed, locking element 64 engages forward edge 78 of slot 60, and leaf spring 32 engages horizontal element 52. Spring 32 biases lever end 28 upwardly, and accordingly opposite end 26 downwardly, about rivet 76. In this locked position, projecting tab 68 extends through slots 60 and 31 and engages forward edge 78 of slot 60 as well as forward edge 80 of drawer rail slot 31. Therefore, locking lever 24 prevents mounting strip 14 from moving forwardly on drawer rail 18. The projecting tabs and locking lever securely lock strip 14 and rail 18 together preventing any movement therebetween either laterally or vertically.

Figure 6:
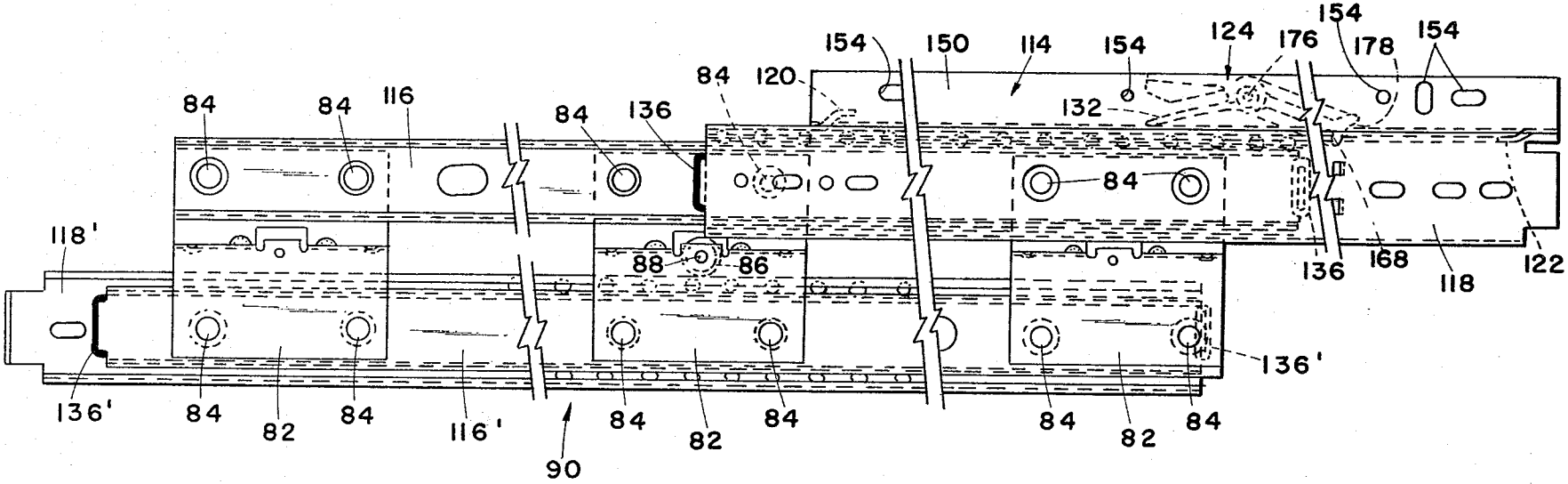
FIG. 6 is an elevational view of an alternative slide assembly including the locking lever of the present invention.
Figure 7:
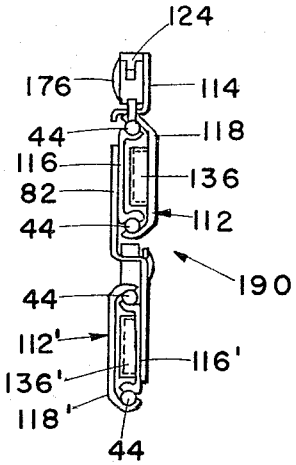
FIG. 7 is an elevational view taken along plane VII—VII in FIG. 6.

The locking lever and mounting strip are shown mounted on an alternative drawer slide in FIGS. 6 and 7 (wherein elements analogous to elements in FIGS. 1–5 are designated by the same numeral and preceded by a 1, for example 12 and 112). Drawer slide 190 of FIGS. 6 and 7 is a double slide wherein two slide assemblies 112 and 112' of the type shown in FIGS. 1 and 2 are positioned one above the other in a substantially vertical plane. Mounting strip 114 is mounted on drawer rail 118 of upper assembly 112 as described above. Specifically, the rear edge of horizontal element 152 is slid under drawer rail tab 120, and mounting strip tab 122 is inserted under the forward edge of drawer rail 118. Locking lever 124 is pivotally mounted to vertical element 150 by rivet 176 so that spring 132 urges projecting tab 168 downwardly and into engagement with forward edge 178 of mounting strip slot 160 and the forward edge 180 of drawer slide slot 131. Therefore, as before, mounting strip 114 is locked onto drawer rail 118.

Each of slide assemblies 112 and 112' of the alternative slide assembly 90 are substantially identical to slide assembly 12 described above. Assemblies 112 and 112' are mounted one above the other using interconnecting brackets 82. Brackets 82 are S-shaped in cross section (FIG. 7) so that the brackets abut both cabinet rails 116 and 116' of assemblies 112 and 112'. Brackets 82 are secured to the cabinet rails by rivets 84. Fastened to center bracket 82 using rivet 88 is roller 86. Roller 86 aids in supporting bracket 82 on drawer rail 118' of lower assembly 112'. Roller 86 also provides a smooth rolling engagement between brackets 82 and drawer rails 118' so that as bracket 82 moves with cabinet rail 116, bracket 82 is free to roll along drawer rail 118'. The double slide arrangement shown in FIGS. 6 and 7 permits greater extension of the drawer from the cabinet because the full extension of two slides may be taken advantage of rather than simply one.

OPERATION

Installation of drawer 10 in the cabinet is greatly facilitated by the present invention. Cabinet rail 16 is secured to the interior of the cabinet using screws or other fastening means. Likewise, mounting strip 14 is mounted on drawer 10. Drawer 10 is then inserted into the cabinet on assembly 12 by placing the rear edge of horizontal element 52 on the upper surface of drawer rail 18 and then pushing drawer 10 into the cabinet. As horizontal element 52 slides along drawer rail 18, projecting tab 68 on locking lever 24 will be forced upwardly as the tab passes over the forward edge of drawer rail 18. However, spring 32 biases tab 68 downwardly against rail 18. As element 52 slides further along rail 18, tabs 20 and 22 will engage horizontal member 52 and rail 18. Finally projecting tab 68 wil snap downwardly into its locked position (FIG. 1) after passing forward edge 80 of drawer rail slot 31. Because drawer 10 is slid horizontally into the cabinet, no clearance is required above the drawer opening in the cabinet in order to install drawer 10 on assembly 12.

When so installed, mounting strip 14 is prevented from moving laterally with respect to drawer rail 18 by the projecting tab 68 engaging rail 18. Strip 14 and rail 18 are held vertically together by tabs 20 and 22. Therefore, mounting rail 14 and drawer 10 are securely retained on drawer rail 18. Drawer 10 is free to be pushed into and withdrawn from the cabinet on slide assembly 12. Of course a mounting strip and slide assembly are required on both sides of the drawer to support the drawer within.

Drawer 10 can also be easily detached from assembly 12 for cleaning or maintenance. The drawer is first withdrawn from the cabinet a sufficient distance to expose lever 24. One then depresses actuator arm 70 rotating lever 24 about aperture 30 raising locking element 64 out of slots 31 and 60. Mounting strip 14 can then be slid forwardly on rail 18 so that tabs 20 and 22 disengage strip 14 and rail 18, respectively, allowing the drawer to be withdrawn from the cabinet. When the cleaning or maintenance is complete, the drawer may be reinstalled in the above described manner.

Of course, it is understood that the above is merely a preferred embodiment of the invention and that various changes and alterations can be made without departing from the spirit and broader aspects of the invention as set forth in the appended claims, which are to be interpreted in accordance with the principles of patent law including the doctrine of equivalents.

The embodiments of the invention in which an exclusive property or privilege is claimed are defined as follows:

1. A one-piece polymeric drawer locking lever comprising:

pivotal mount means for pivotally securing said locking lever to an object;

a substantially rigid locking arm integral with and extending generally radially from said pivotal mount means and terminating in a locking element;

a resiliently deformable spring arm integral with and extending generally radially from said pivotal mount means, said spring arm and said locking arm generally defining an obtuse angle; and a substantially rigid actuator arm integral with and extending generally radially from said pivot mount means, said actuator arm being located outside of said obtuse angle, whereby said actuator arm can be shifted to pivot said lever about said pivot mount means deforming said spring arm and shifting said locking arm.

2. The drawer locking lever in claim 1 wherein said actuator element comprises a depressor surface and an opposite overspring stop to limit pivoting of said lever.

3. The drawer locking lever in claim 1 further comprising stop means integral with said locking arm for limiting the shifting of said locking arm under the bias of said spring arm.

4. The drawer locking lever in claim 3 wherein said stop means comprises a projecting tab.

5. A drawer mounting strip and locking lever combination comprising:

an elongated drawer mounting strip having a vertical element for attachment to a drawer, and a lateral element;

a one-piece locking lever having a pair of generally opposite ends and pivotal mount means between said ends for pivotally mounting said lever to said vertical element;

an integral locking element at one of said ends releasably engaging said lateral element upon pivotal movement of said lever;

an integral deformable spring at the other of said ends in resilient engagement with said lateral element and having an inherent bias to serve as a spring for shifting said locking element toward engagement with said lateral element; and an integral actuator portion at said other end to allow manual pivoting of said lever for deformation of said spring against its inherent bias to release said locking element.

6. The drawer mounting strip and locking lever combination in claim 5 wherein said lever, locking element, spring, and actuator portion comprise a unitary, polymeric element.

7. The drawer mounting strip and locking lever combination in claim 5 wherein said actuator portion includes an overspring stop to limit pivoting of said lever and thereby prevent excessive deformation of said spring.

8. The drawer mounting strip and locking lever combination in claim 5 including a stop surface on said locking element to limit the shifting of said locking element under the bias of said spring.

* * * * *